US007104813B1

(12) United States Patent
Chuang

(10) Patent No.: US 7,104,813 B1
(45) Date of Patent: Sep. 12, 2006

(54) POWER PLUG STRUCTURE

(76) Inventor: Yu-Chin Chuang, No. 31, Lane 15, Chung Shin Street, Lu Chou City, Taipei Hsien (TW)

( * ) Notice: Subject to any disclaimer, the term of this patent is extended or adjusted under 35 U.S.C. 154(b) by 0 days.

(21) Appl. No.: 11/199,073

(22) Filed: Aug. 9, 2005

(51) Int. Cl.
*H01R 13/44* (2006.01)

(52) U.S. Cl. ..... 439/131; 439/104

(58) Field of Classification Search ..... 439/131, 439/104, 103
See application file for complete search history.

(56) References Cited

U.S. PATENT DOCUMENTS 4,997,381 A * 3/1991 Oh ..... 439/172
5,401,178 A * 3/1995 Liu ..... 439/131
6,059,584 A * 5/2000 Mareno ..... 439/131
6,275,002 B1 * 8/2001 Chen ..... 320/111
6,312,271 B1 * 11/2001 Tseng ..... 439/131
6,398,566 B1 * 6/2002 Chen ..... 439/131
6,494,727 B1 * 12/2002 Wen-Ching ..... 439/131
6,722,900 B1 * 4/2004 Segawa et al. ..... 439/131
6,793,509 B1 * 9/2004 Chen ..... 439/136

* cited by examiner

*Primary Examiner*—Gary Paumen
(74) *Attorney, Agent, or Firm*—Rosenberg, Klein & Lee

(57) ABSTRACT

A power plug structure includes an insulating main body formed with a pair of receiving splits. A power cable having a first and a second electrodes mounted in the main body. A first and a second contact members mounted in the main body and respectively connected with the first and second electrodes of the power cable. A first and a second plug terminals respectively pivotally connected with the first and second contact members. A rotary seat body in which the first and second plug terminals are inlaid. The rotary seat body and the first and second plug terminals can be rotated relative to the insulating main body, whereby the first and second terminals can be received in the receiving splits of the insulating main body.

2 Claims, 10 Drawing Sheets

POWER PLUG STRUCTURE

BACKGROUND OF THE INVENTION

1. Field of the Invention

The present invention is related to an improved power plug structure in which the plug terminals can be moved and received in a pair of receiving splits of the insulating main body.

2. Description of the Prior Art

A conventional power plug has an insulating main body and at least a pair of terminals fixedly protruding from the main body. The terminals can be plugged into a corresponding power socket. When not used, the fixed terminals cannot be folded to change the angle contained between the terminals and the main body. In addition, after plugged into the socket, the main body often protrudes from the wall face to hinder other appliance from being used. An improved power plug has been developed to solve the above problem. The terminals of the plug can be rotated to change the angle contained between the terminals and the main body. After plugged into the socket, the main body can be folded to attach to the wall face.

However, the above power plug still has some shortcomings as follows:

1. The terminals cannot be accommodated in the insulating main body. The terminals are always exposed to outer side of the main body and tend to be deformed and damaged due to compression (such as tread).

2. The terminals have sharp edges. In some cases, the soft power cable will be cut by the sharp edges of the terminals. This may result in leakage of electricity.

3. The terminals of the plug are arranged in standard pattern and at standard intervals. Some power plug has two terminals. Some other power plug has three terminals including a grounding terminal. In the case of three terminals, the pivoted ends of the terminals are often too close to each other. This often results in short circuit.

SUMMARY OF THE INVENTION

It is therefore a primary object of the present invention to provide an improved power plug structure including: an insulating main body, one end of the main body being formed with a notch, the main body being further formed with a first receiving split communicating with the notch and a second receiving split communicating with the notch, the first and second receiving splits being parallel to each other; a power cable having a first and a second electrodes mounted in the insulating main body; a first contact member mounted in the insulating main body, one end of the first contact member being electrically connected with the first electrode of the power cable, the other end of the first contact member being formed as a pivoted end; a second contact member mounted in the insulating main body, one end of the second contact member being electrically connected with the second electrode of the power cable, the other end of the second contact member being formed as a pivoted end; a first plug terminal having a first section and a second section, the first section being formed with a first pivoted section pivotally connected with the pivoted end of the first contact member, the second section of the first plug terminal being receivable in the first receiving split of the insulating main body; a second plug terminal parallel to the first plug terminal, the second plug terminal having a first section and a second section, the first section being formed with a second pivoted section pivotally connected with the pivoted end of the second contact member, the second section of the second plug terminal being receivable in the second receiving split of the insulating main body, a gap between the first and second pivoted sections being defined as a first gap, a gap between the second sections of the first and second plug terminals being defined as a second gap, the first gap being larger than the second gap; and a rotary seat body in which the first sections of the first and second plug terminals are inlaid, the rotary seat body being pivotally connected in the notch of the insulating main body.

It is a further object of the present invention to provide an improved power plug structure including: an insulating main body, one end of the main body being formed with a notch, the main body being further formed with a first receiving split communicating with the notch and a second receiving split communicating with the notch, the first and second receiving splits being parallel to each other; a power cable having a first and a second electrodes and a grounding electrode mounted in the insulating main body; a first contact member mounted in the insulating main body, one end of the first contact member being electrically connected with the first electrode of the power cable, the other end of the first contact member being formed as a pivoted end; a second contact member mounted in the insulating main body, one end of the second contact member being electrically connected with the second electrode of the power cable, the other end of the second contact member being formed as a pivoted end; a grounding contact member mounted in the insulating main body, one end of the grounding contact member being electrically connected with the grounding electrode of the power cable, the other end of the grounding contact member being formed as a pivoted end; a first plug terminal having a first section and a second section, the first section being formed with a first pivoted section pivotally connected with the pivoted end of the first contact member, the second section of the first plug terminal being receivable in the first receiving split of the insulating main body; a second plug terminal parallel to the first plug terminal, the second plug terminal having a first section and a second section, the first section being formed with a second pivoted section pivotally connected with the pivoted end of the second contact member, the second section of the second plug terminal being receivable in the second receiving split of the insulating main body, a gap between the first and second pivoted sections being defined as a first gap, a gap between the second sections of the first and second plug terminals being defined as a second gap, the first gap being larger than the second gap; a grounding plug terminal parallel to the first and second plug terminals, the grounding plug terminal having a first section and a second section, the first section being formed with a third pivoted section pivotally connected with the pivoted end of the grounding contact member; an extension insulator having a first end and a second end, the first end of the extension insulator being inserted in the insulating main body, the second end of the extension insulator extending to the notch of the insulating main body, the pivoted end of the grounding contact member being inlaid in the extension insulator; and a rotary seat body having a recess in which the extension insulator is disposed, the first sections of the first and second plug terminals being inlaid in the rotary seat body, the rotary seat body being pivotally connected in the notch of the insulating main body.

The present invention can be best understood through the following description and accompanying drawings wherein:

DETAILED DESCRIPTION OF THE PREFERRED EMBODIMENTS

Figure 1:
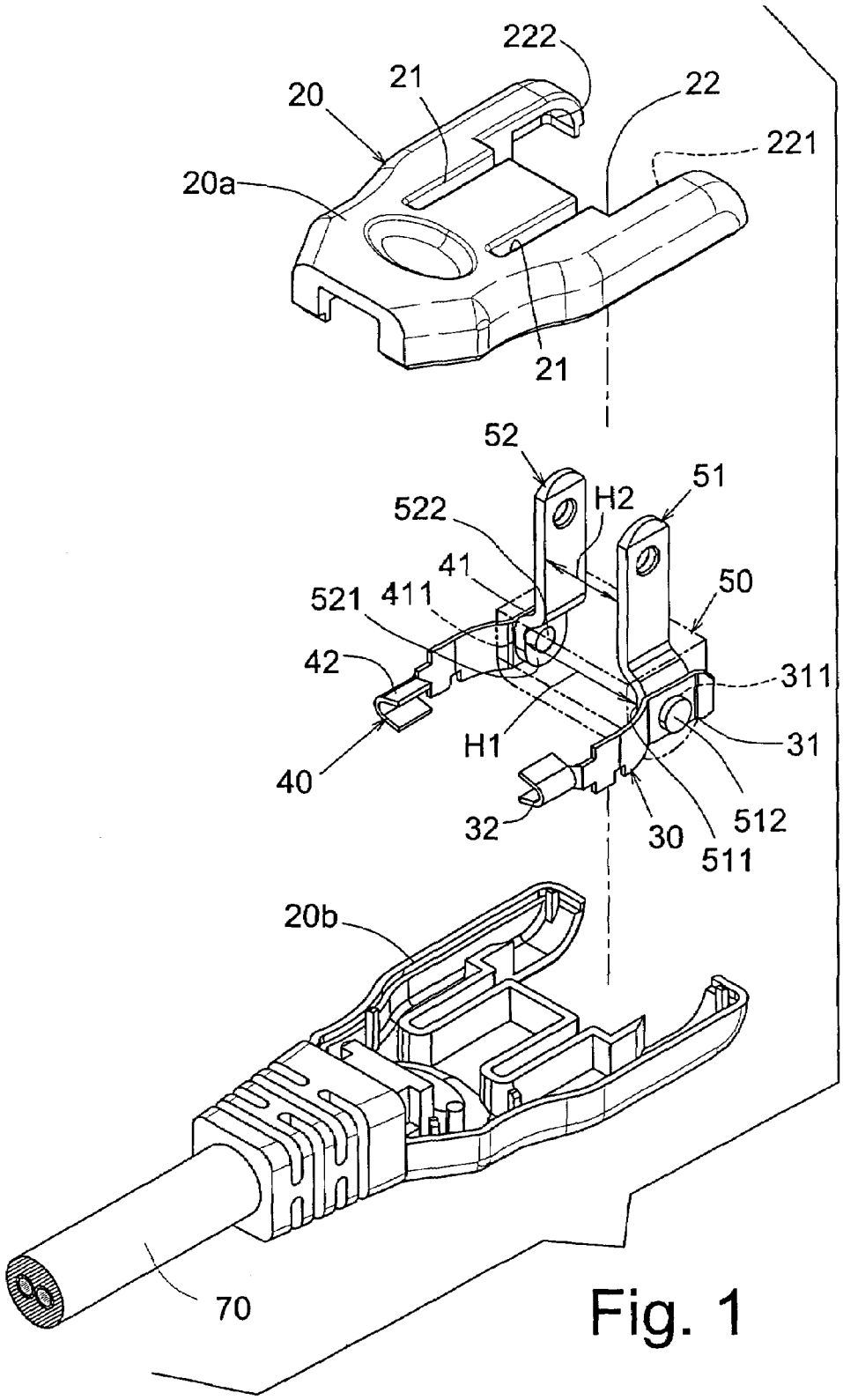
FIG. 1 is a perspective exploded view of the present invention.
Figure 2:
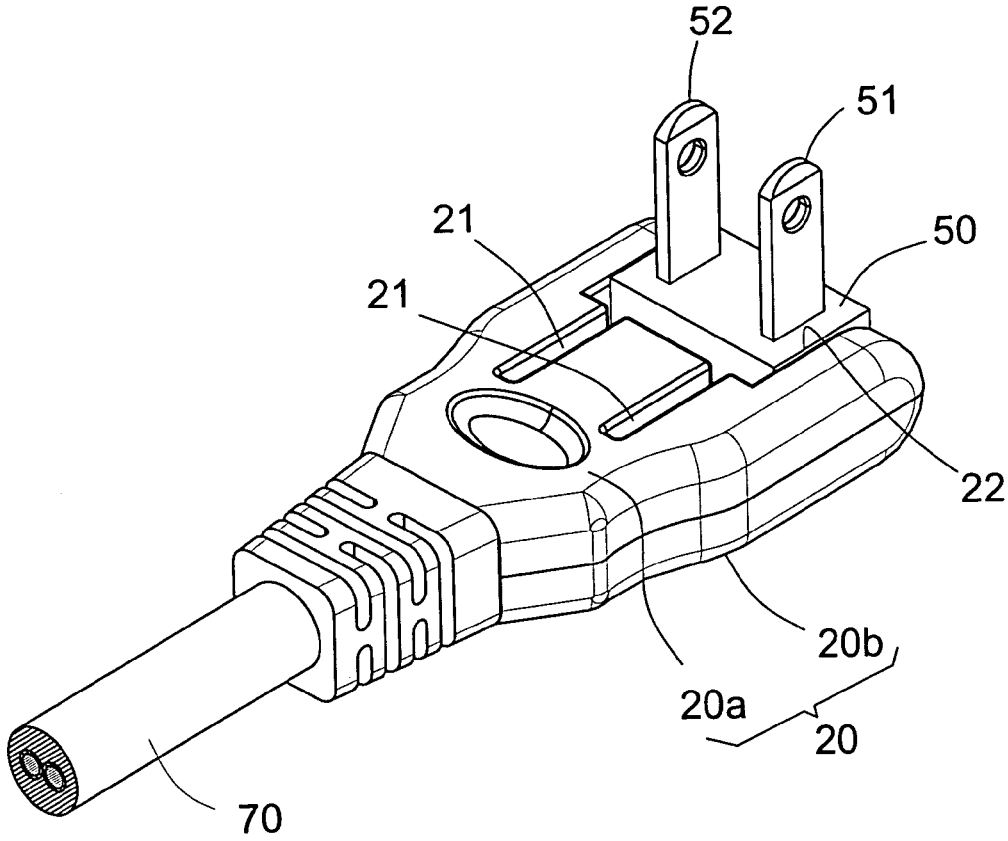
FIG. 2 is a perspective assembled view of the present invention.
Figure 3:
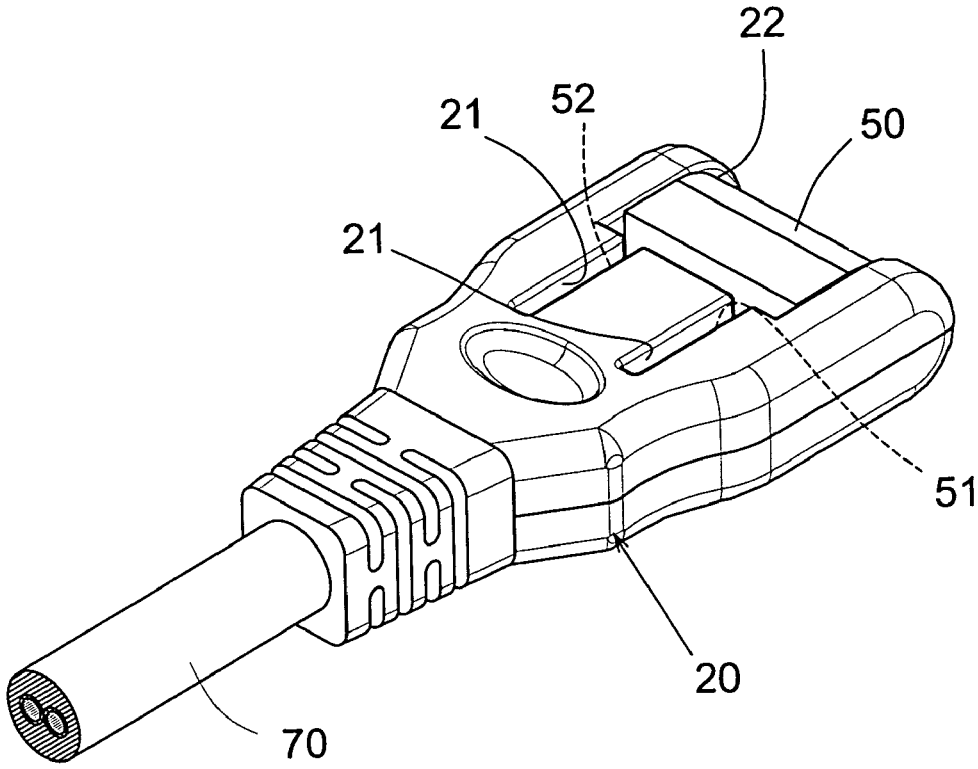
FIG. 3 is a perspective assembled view according to FIG. 2, showing that the first and second plug terminals are received in the insulating main body of the power plug of the present invention.
Figure 4:
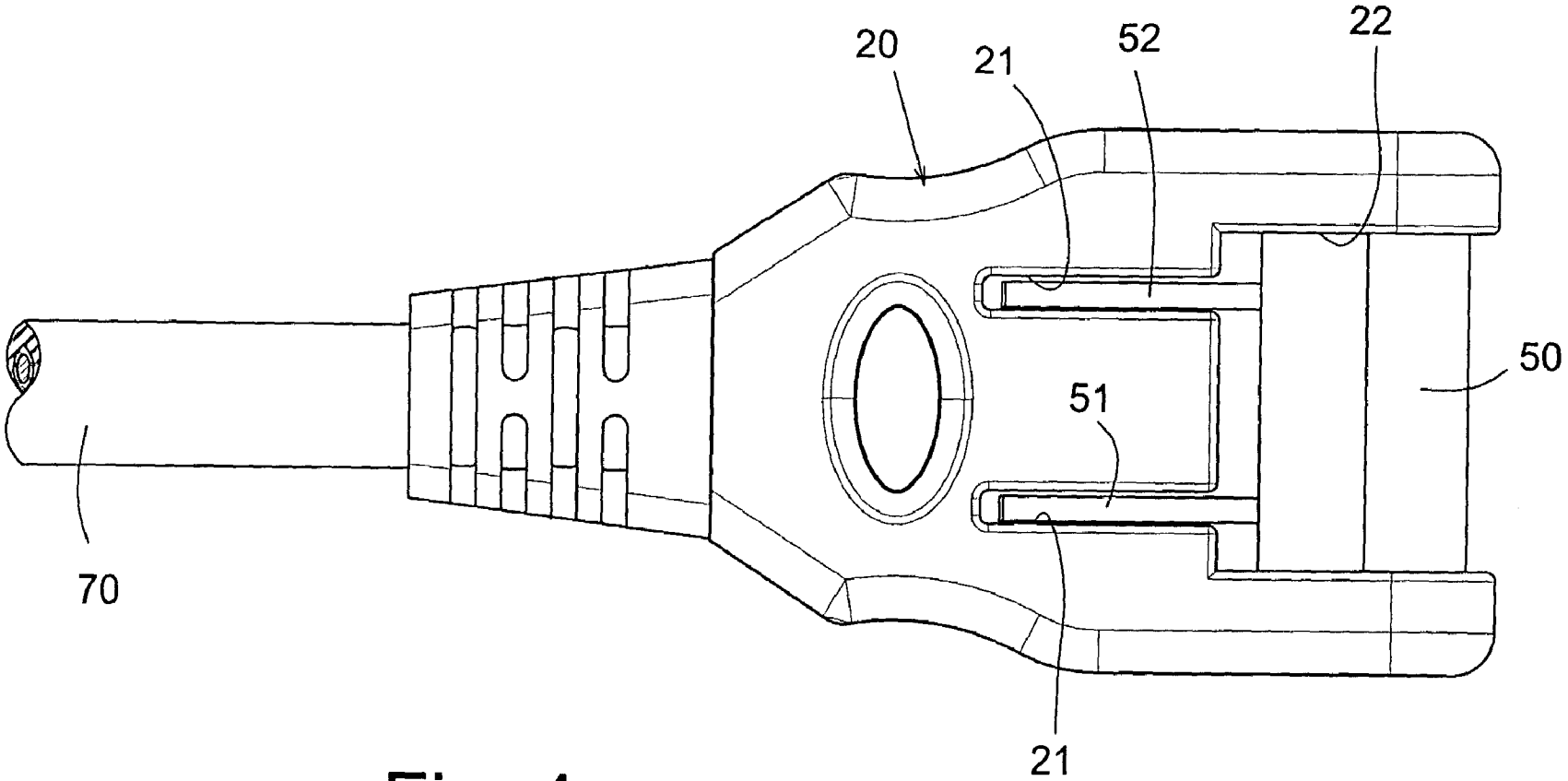
FIG. 4 is a top view according to FIG. 3.

Please refer to FIGS. 1 to 5. The power plug structure of the present invention includes: an insulating main body 20; a power cable 70 having a first and a second electrodes (not shown mounted in the main body 20; a first contact member 30 mounted in first side of the main body 20 and connected with the first electrode of the power cable 70, a front section of the first contact member 30 being formed with a pivoted section 31; a second contact member 40 mounted in second side of the main body 20 and connected with the second electrode of the power cable 70, a front section of the second contact member 40 being formed with a pivoted section 41; and a rotary seat body 50 in which a first plug terminal 51 and a second plug terminal 52 are inlaid. Rear sections 511, 521 of the first and second terminals 51, 52 are pivotally connected with the first and second contact members 30, 40 via pivot shafts 512, 522, whereby the rotary seat body 50 can be rotated about the pivot shafts 512, 522.

The present invention is characterized in that the insulating main body 20 is formed with a pair of receiving splits 21 projectively corresponding to the rotational path of the first and second terminals 51, 52. When the rotary seat body 50 is rotated to a certain angle, the first and second terminals 51, 52 are moved into the receiving splits 21.

Referring to FIGS. 1 to 5, the insulating main body 20 is composed of a first casing 20*a* and a second casing 20*b* mated with each other. A front end of the main body 20 is formed with a notch 22 in which the rotary seat body 50 is mounted. Two opposite sidewalls of the notch 22 are respectively formed with two holes 221, 222. The receiving splits 21 are parallel to each other and communicate with the notch 22.

A rear end of the first contact member 30 is formed with a chucking seat 32 for chucking the bare wire (not shown) of the first electrode of the power cable 70. The front section of the first contact member 30 is bent and extends to the front end of the first side of the main body 20. The pivoted section 31 of the first contact member 30 is formed with a pivot hole 311 near the first side of the notch 22. The pivot hole 311 is aligned with the hole 221 of the first sidewall of the notch 22. The pivot shaft 512 extends through the pivot hole 311 into the hole 221 to pivotally connect the first contact member 30 with the first plug terminal 51.

A rear end of the second contact member 40 is formed with a chucking seat 42 for chucking the bare wire (not shown) of the second electrode of the power cable 70. The front section of the second contact member 40 is bent and extends to the front end of the second side of the main body 20. The pivoted section 41 of the second contact member 40 is formed with a pivot hole 411 near the second side of the notch 22. The pivot hole 411 is aligned with the hole 222 of the second sidewall of the notch 22. The pivot shaft 522 extends through the pivot hole 411 into the hole 222 to pivotally connect the second contact member 40 with the second plug terminal 52.

The first and second plug terminals 51, 52 are partially integrally wrapped in the rotary seat body 50 formed by injection molding. Alternatively, the first and second plug terminals 51, 52 can be parts separable from the rotary seat body 50.

Figure 5:
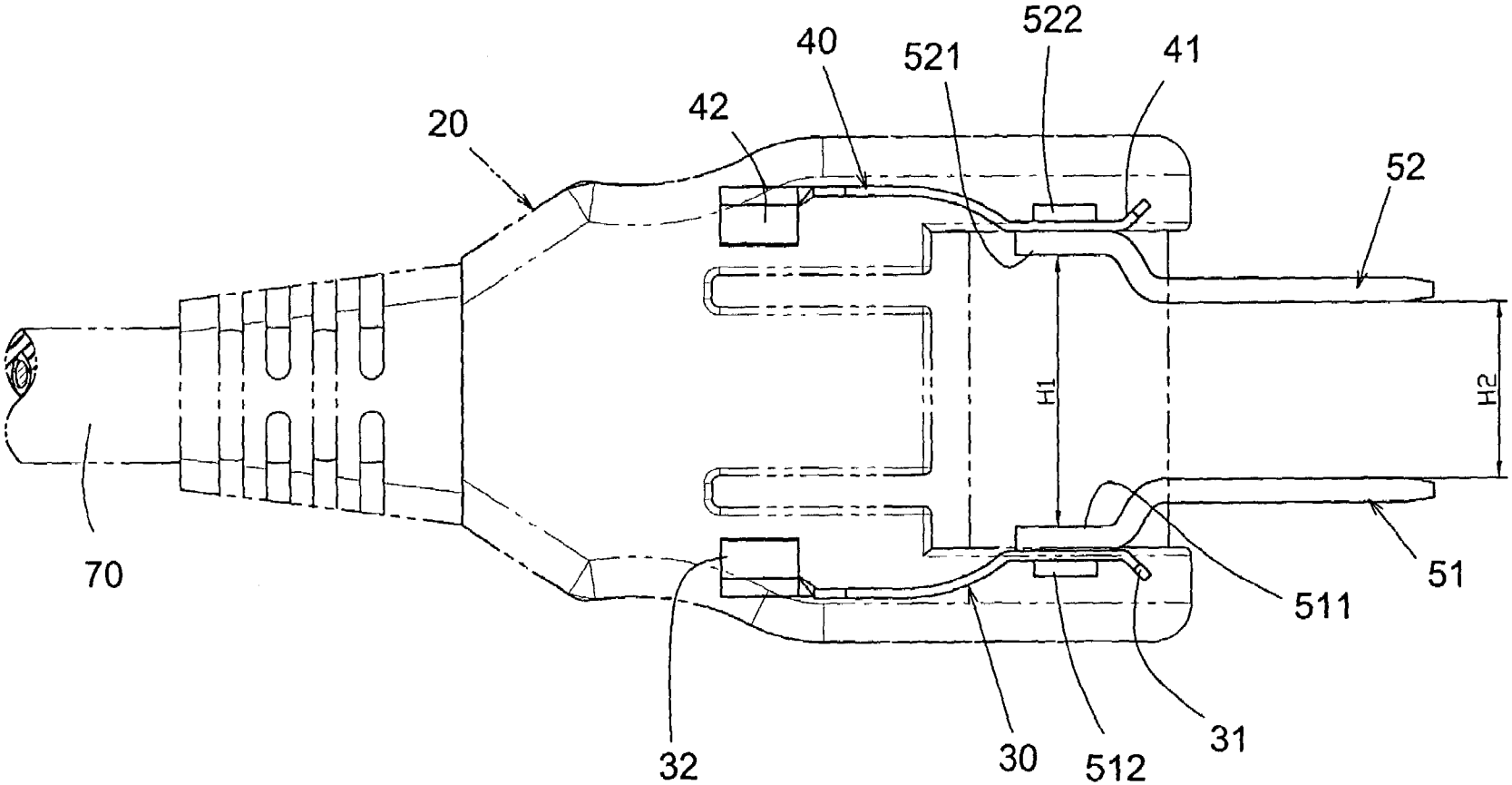
FIG. 5 shows the relationship between the first and second contact members and the first and second plug terminals of the present invention.

Please refer to FIGS. 1 and 5. The present invention is further characterized in that the rear sections of the first and second plug terminals 51, 52 inlaid in the rotary seat body 50 are outward bent and biased. The gap between the pivoted sections of the first and second terminals 51, 52 is defined as first gap H1, while the gap between the plugged sections of first and second terminals is defined as second gap H2. The first gap H1 is larger than the second gap H2. Accordingly, the rotary seat body 50 has larger width to enhance the strength of the rotary seat body 50. In addition, the gap between the rear sections of the first and second terminals 51, 52 is enlarged to avoid short circuit and ensure safety.

FIGS. 6 to 9 show another type of power plug of the present invention. The power plug has a grounding terminal 53.

Referring to FIGS. 6 to 9, the power plug includes an insulating main body 20' composed of a first casing 20*a*' and a second casing 20*b*' mated with each other. The front end of the main body 20' is formed with a notch 22 in which an extension insulator 20*c* is inlaid. Two sides of the extension insulator 20*c* are spaced from the sidewalls of the notch 22 by a certain distance. A power cable 70' having a first and a second electrodes and a grounding electrode (not shown) is mounted in the main body 20'. A first contact member 30 is mounted in first side of the main body 20' and connected with the first electrode of the power cable 70'. A front section of the first contact member 30 is formed with a pivoted section 31 extending to a first side of the notch 22. A second contact member 40 is mounted in second side of the main body 20' and connected with the second electrode of the power cable 70'. A front section of the second contact member 40 being formed with a pivoted section 41 extending to a second side of the notch 22. The power plug further includes a grounding contact member 60. A rear section of the grounding contact member 60 extends into the main body 20' to connect with the grounding electrode (not shown) of the power cable 70'. A front section of the grounding contact member 60 is inlaid in one side of the extension insulator 20*c* and formed with a pivot hole 61. A rotary seat body 50' is mounted in the notch 22 of the main body 20'. A rear end of the rotary seat body 50' is formed with a recess 54 in which the extension insulator 20*c* is disposed. A first plug terminal 51 and a second plug terminal 52 are fixedly inlaid in the rotary seat body 50'. Rear sections of the first and second terminals 51, 52 are pivotally connected with the first and second contact members 30, 40 via pivot shafts 512, 522, whereby the rotary seat body 50' can be rotated about the pivot shafts 512, 522. A grounding plug terminal 53 is inserted in the rotary seat body 50'. A rear section of the grounding terminal 53 extends to the front section of the grounding contact member 60. A pivot shaft 531 is fitted in the pivot hole 61 of the grounding contact member 60 to pivotally connect the rear section of the grounding terminal 53 with the front section of the grounding contact member 60.

The insulating main body 20' is also formed with at least one pair of receiving splits 21 projectively corresponding to the rotational path of the first and second terminals 51, 52. When the rotary seat body 50' is rotated to a certain angle, the first and second terminals 51, 52 are moved and received in the receiving splits 21. At this time, the grounding plug terminal 53 attaches to the insulating main body 20'. Accordingly, the first and second terminals 51, 52 and the grounding terminal 53 will not longitudinally protrude from the main body 20' so as to avoid deformation and damage caused by compression.

Figure 6:
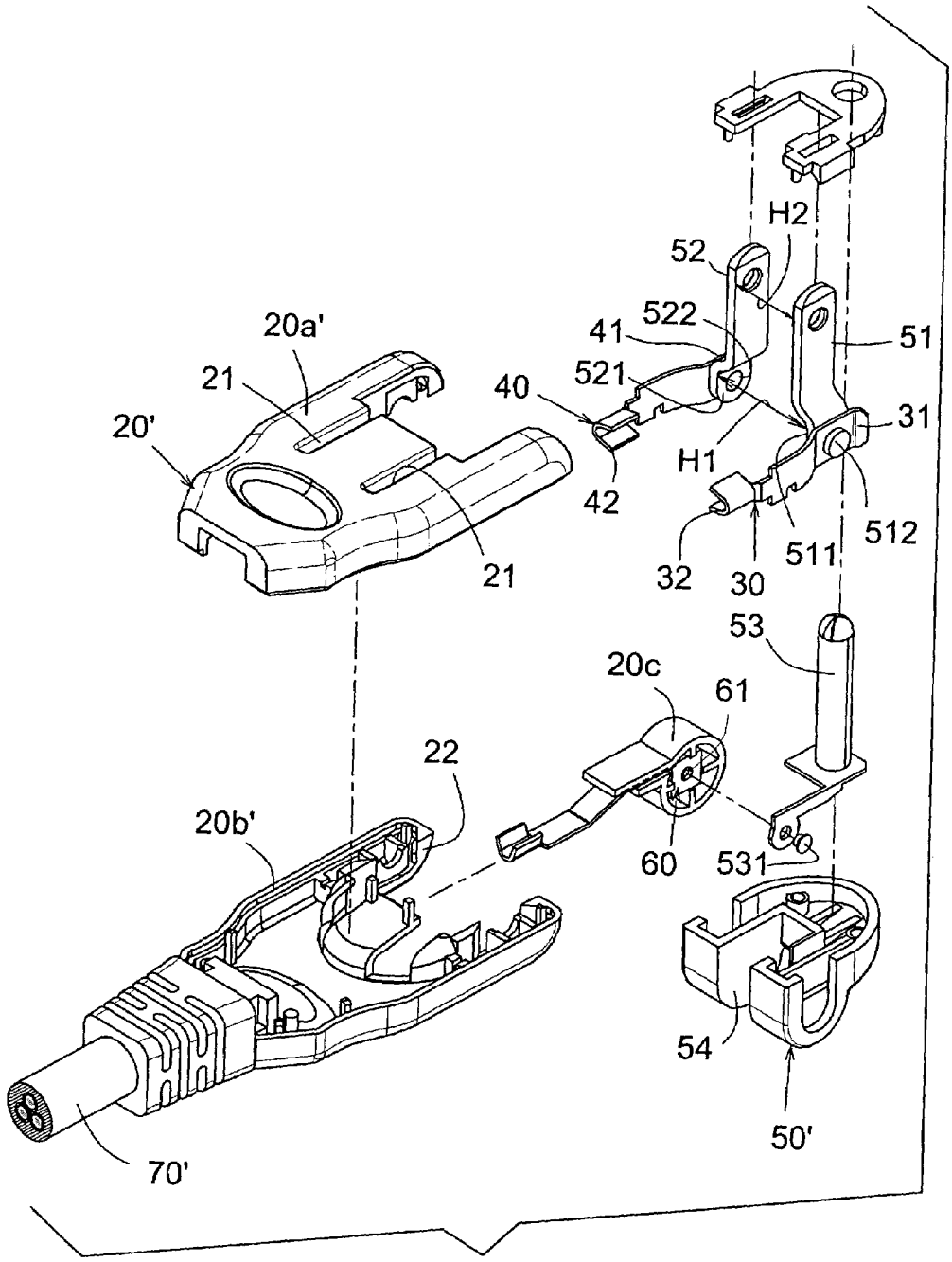
FIG. 6 is a perspective exploded view of a second embodiment of the present invention.
Figure 7:
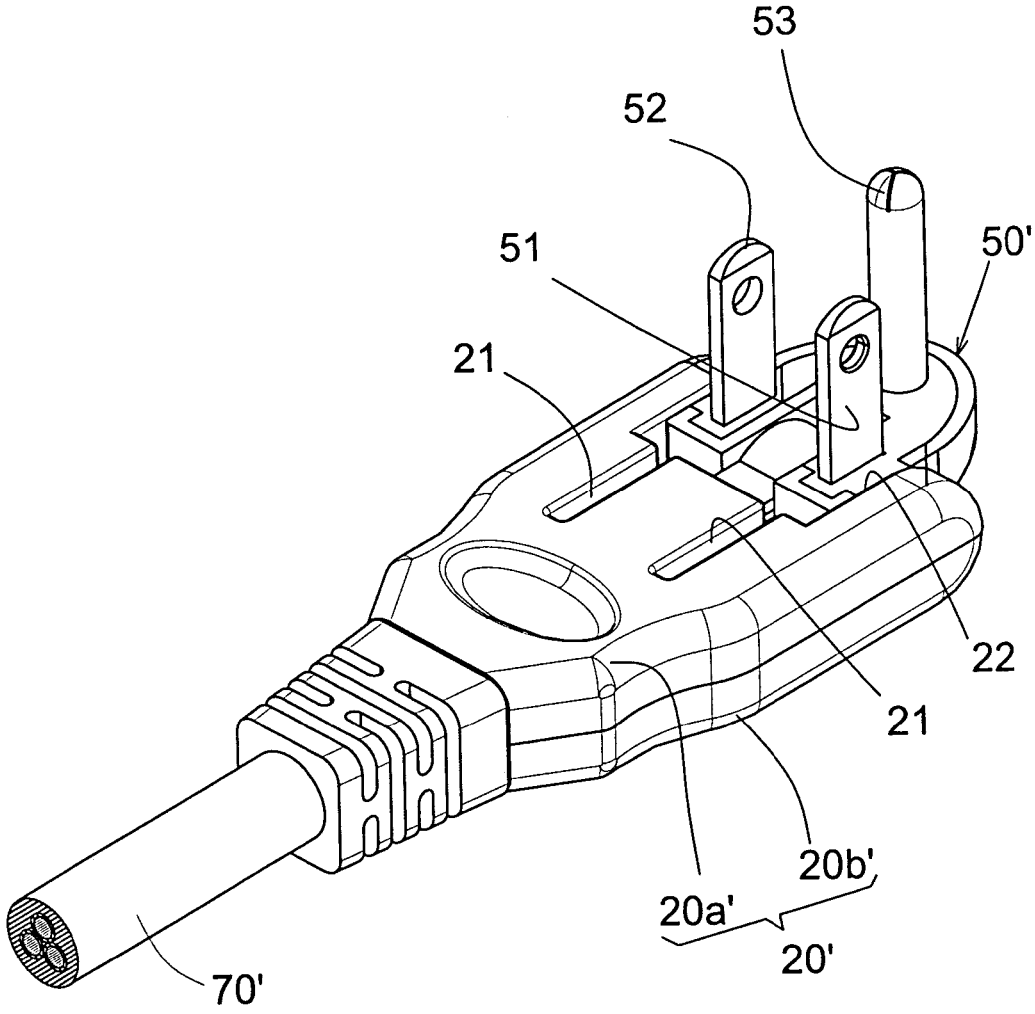
FIG. 7 is a perspective assembled view of the second embodiment of the present invention.
Figure 8:
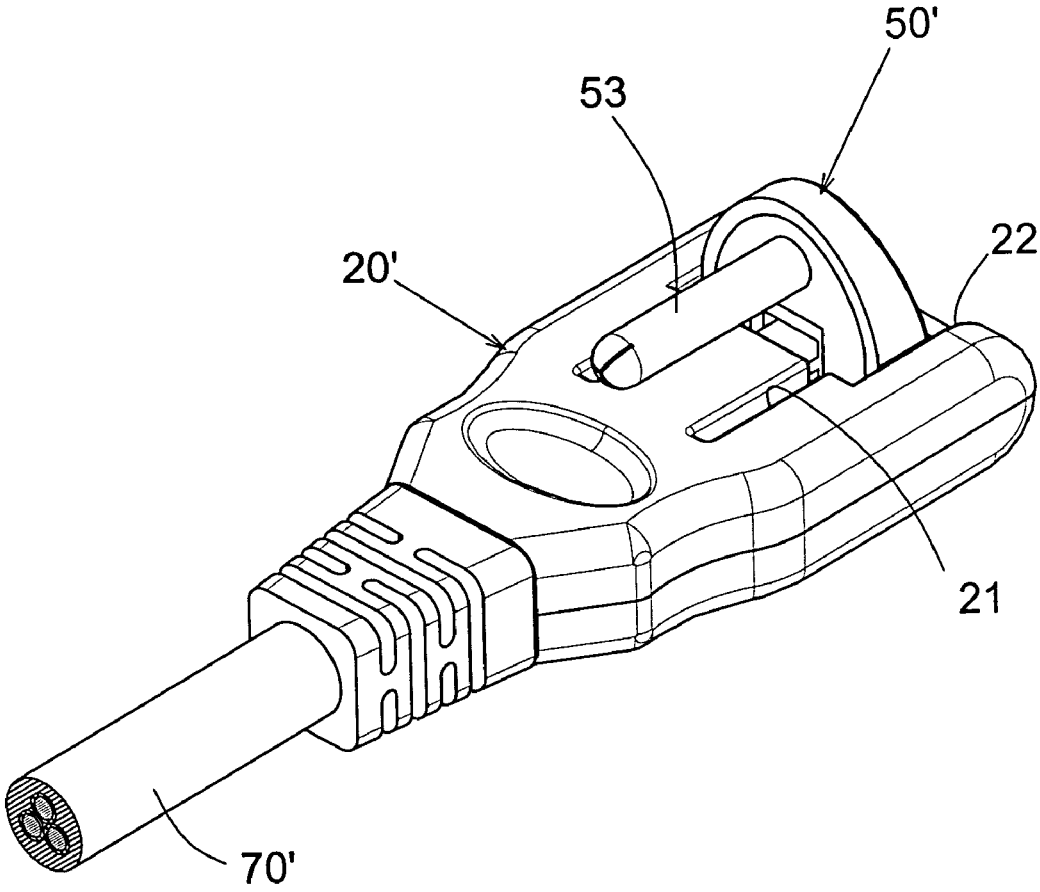
FIG. 8 is a perspective assembled view according to FIG. 7, showing that the first and second plug terminals are received in the insulating main body of the power plug of the present invention.
Figure 9:
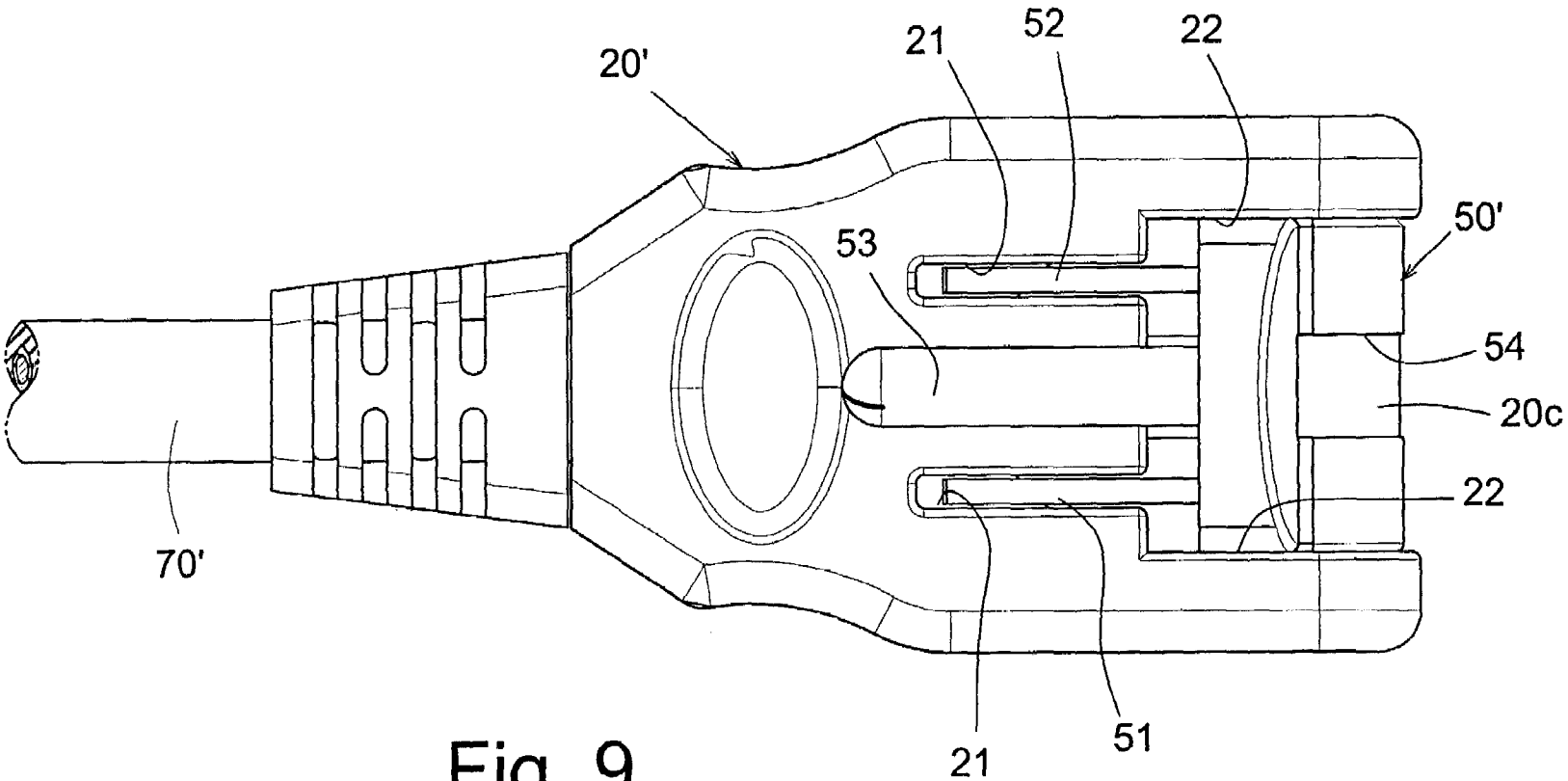
FIG. 9 is a top view according to FIG. 8.
Figure 10:
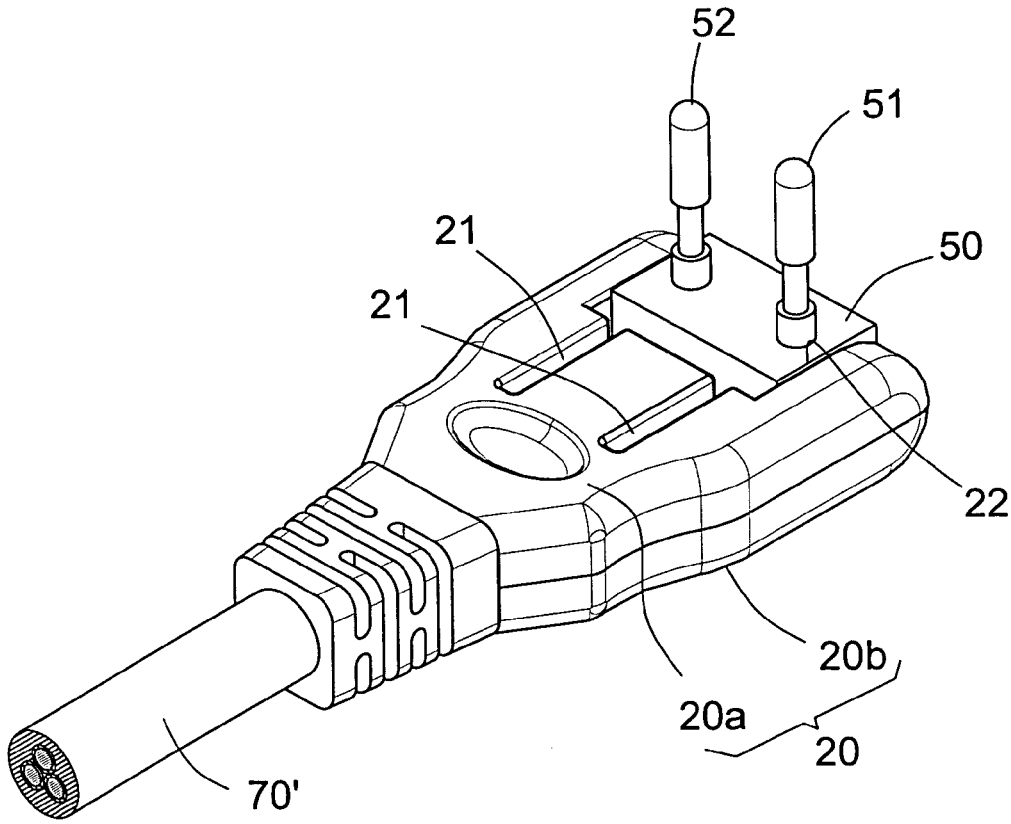
FIG. 10 is a perspective assembled view of a third embodiment of the present invention.

Please refer to FIG. 6. The rear sections 511, 521 of the first and second plug terminals 51, 52 inlaid in the rotary seat body 50' are outward bent and biased. The gap between the rear sections of the first and second terminals 51, 52 is defined as first gap H1, while the gap between the front sections of first and second terminals is defined as second gap H2. The first gap H1 is larger than the second gap H2. Accordingly, the rotary seat body 50' has larger width to enhance the strength of the rotary seat body 50'. In addition, the first and second terminals 51, 52 are spaced from the grounding terminal 53 by an elongated distance so as to avoid short circuit and ensure safety.

As shown in FIG. 6, alternatively, the rotary seat body 50' can be composed of several components mated with each other.

According to the above arrangement, the power plug structure of the present invention has the following advantages:

1. The insulting main body is formed with a pair of receiving splits. After the rotary seat body is rotated by a certain angle, the first and second terminals are moved into and received in the receiving splits. At this time, the grounding plug terminal attaches to the insulating main body. Accordingly, the deformation and damage of the power plug caused by compression can be avoided.

2. The plug terminals can be totally folded into the receiving splits. Therefore, the power cable will not be cut by the sharp edges of the plug terminals so as to avoid leakage of electricity.

3. The rear sections of the first and second plug terminals are outward bent and biased, whereby the gap between the rear sections of the first and second terminals is larger than the gap between the front sections of first and second terminals. Accordingly, the rotary seat body has larger width to enhance the strength of the rotary seat body. In addition, the gap between the rear sections of the first and second terminals is enlarged so that the first and second terminals are spaced from the grounding terminal by an elongated distance so as to avoid short circuit and ensure safety.

The above embodiments are only used to illustrate the present invention, not intended to limit the scope thereof. Many modifications of the above embodiments can be made without departing from the spirit of the present invention.

What is claimed is:

1. A power plug structure comprising:

(a) an insulating main body, one end of the main body being formed with a notch, the main body being further formed with a first receiving split communicating with the notch and a second receiving split communicating with the notch, the first and second receiving splits being parallel to each other;

(b) a power cable having a first and a second electrodes mounted in the insulating main body;

(c) a first contact member mounted in the insulating main body, one end of the first contact member being electrically connected with the first electrode of the power cable, the other end of the first contact member being formed as a pivoted end;

(d) a second contact member mounted in the insulating main body, one end of the second contact member being electrically connected with the second electrode of the power cable, the other end of the second contact member being formed as a pivoted end;

(e) a first plug terminal having a first section and a second section, the first section being formed with a first pivoted section pivotally connected with the pivoted end of the first contact member, the second section of the first plug terminal being receivable in the first receiving split of the insulating main body;

(f) a second plug terminal parallel to the first plug terminal, the second plug terminal having a first section and a second section, the first section being formed with a second pivoted section pivotally connected with the pivoted end of the second contact member, the second section of the second plug terminal being receivable in the second receiving split of the insulating main body, a gap between the first and second pivoted sections being defined as a first gap, a gap between the second sections of the first and second plug terminals being defined as a second gap, the first gap being larger than the second gap; and (g) a rotary seat body in which the first sections of the first and second plug terminals are inlaid, the rotary seat body being pivotally connected in the notch of the insulating main body.

2. A power plug structure comprising:

(a) an insulating main body, one end of the main body being formed with a notch, the main body being further formed with a first receiving split communicating with the notch and a second receiving split communicating with the notch, the first and second receiving splits being parallel to each other;

(b) a power cable having a first and a second electrodes and a grounding electrode mounted in the insulating main body;

(c) a first contact member mounted in the insulating main body, one end of the first contact member being electrically connected with the first electrode of the power cable, the other end of the first contact member being formed as a pivoted end;

(d) a second contact member mounted in the insulating main body, one end of the second contact member being electrically connected with the second electrode of the power cable, the other end of the second contact member being formed as a pivoted end;

(e) a grounding contact member mounted in the insulating main body, one end of the grounding contact member being electrically connected with the grounding electrode of the power cable, the other end of the grounding contact member being formed as a pivoted end;

(f) a first plug terminal having a first section and a second section, the first section being formed with a first pivoted section pivotally connected with the pivoted end of the first contact member, the second section of the first plug terminal being receivable in the first receiving split of the insulating main body;

(g) a second plug terminal parallel to the first plug terminal, the second plug terminal having a first section and a second section, the first section being formed with a second pivoted section pivotally connected with the pivoted end of the second contact member, the second section of the second plug terminal being receivable in the second receiving split of the insulating main body, a gap between the first and second pivoted sections being defined as a first gap, a gap between the second sections of the first and second plug terminals being defined as a second gap, the first gap being larger than the second gap;

(h) a grounding plug terminal parallel to the first and second plug terminals, the grounding plug terminal having a first section and a second section, the first section being formed with a third pivoted section pivotally connected with the pivoted end of the grounding contact member;

(i) an extension insulator having a first end and a second end, the first end of the extension insulator being inserted in the insulating main body, the second end of the extension insulator extending to the notch of the insulating main body, the pivoted end of the grounding contact member being inlaid in the extension insulator; and (j) a rotary seat body having a recess in which the extension insulator is disposed, the first sections of the first and second plug terminals being inlaid in the rotary seat body, the rotary seat body being pivotally connected in the notch of the insulating main body.

* * * * *